United States Patent [19]

Schlosser

[11] Patent Number: 4,774,815

[45] Date of Patent: Oct. 4, 1988

[54] HARVEST PRESSURE REGULATOR VALVE SYSTEM

[75] Inventor: Charles E. Schlosser, New Holstein, Wis.

[73] Assignee: The Manitowoc Company, Inc., Manitowoc, Wis.

[21] Appl. No.: 96,254

[22] Filed: Sep. 8, 1987

Related U.S. Application Data

[63] Continuation of Ser. No. 852,532, Apr. 16, 1986, abandoned.

[51] Int. Cl.[4] ..... F25C 5/10

[52] U.S. Cl. ..... 62/149; 62/196.3; 62/278; 62/352

[58] Field of Search ..... 62/352, 278, 81, 196.3, 62/149, 174

[56] References Cited

U.S. PATENT DOCUMENTS

| | | | |
|---|---|---|---|
| 2,630,685 | 3/1953 | Lewis | 62/81 |
| 2,876,630 | 3/1959 | Boling | 62/278 X |
| 2,960,840 | 11/1960 | Hosken et al. | 62/81 |
| 3,213,637 | 10/1965 | Halls | 62/352 X |
| 3,280,582 | 10/1966 | Knaebel | 62/278 |
| 3,332,251 | 7/1967 | Watkins | 62/278 X |
| 3,651,657 | 3/1972 | Bottum | 62/196.3 |
| 3,838,582 | 10/1974 | Redfern et al. | 62/278 X |
| 3,903,709 | 9/1975 | Anderson et al. | 62/149 X |
| 3,922,875 | 12/1975 | Morris, Jr. | 62/352 X |

OTHER PUBLICATIONS

Manitowoc Service Bulletin No.:SB-18-84; Dated 4/20/84 (Back page).

*Primary Examiner*—William E. Tapoical
*Attorney, Agent, or Firm*—Leydig, Voit & Mayer

[57] ABSTRACT

An ice making system having a compressor, a condenser and an evaporator, and having freeze and harvest cycles. During the harvest cycle, hot vaporous refrigerant is circulated from the compressor to the evaporator through a discharge line. The refrigerant is thereafter returned to the compressor through a supply line. To ensure that a predetermined amount of refrigerant is circulated between the compressor and the evaporator during the harvest cycle, a harvest pressure regulating valve automatically adds vaporous refrigerant to the supply line from the condenser when the pressure therein falls below a predetermined level.

9 Claims, 1 Drawing Sheet

HARVEST PRESSURE REGULATOR VALVE SYSTEM

This is a continuation of copending application Ser. No. 852,532, filed on Apr. 16, 1986, now abandoned.

FIELD OF THE INVENTION

The present invention relates to ice making systems and, in particular, to a pressure regulator valve system activated during the ice harvest or ice removal cycle.

BACKGROUND OF THE INVENTION

The basic principles of refrigeration are derived from the behavior of fluid refrigerants when they change from a liquid to a gas or from a gas to a liquid and absorb or release latent heat to the environment. Such basic principles have long been utilized in ice making systems. Suitable fluid refrigerants include carbon dioxide and halogenated hydrocarbons.

An ice making system is typically made up of three principal components—a compressor, a condenser and an evaporator—which generally comprise a closed system. In normal operation, these components are usually run through a freeze or refrigeration cycle. Periodically, however, ice which accumulates or forms on the evaporator during the freeze cycle must be removed. Typically the accumulated ice is removed during a separate "harvest" or ice removal cycle.

During the freeze cycle, the compressor receives a vaporous refrigerant at low pressure and compresses it, thus increasing the temperature and pressure of the vaporous refrigerant. The compressor then supplies this high temperature, high pressure vaporous refrigerant to the condenser, where the refrigerant condenses, changing from a vapor to a liquid. In the process of condensing, the refrigerant releases heat to the condenser environment. From the condenser, the liquid refrigerant passes through the evaporator, where the liquid refrigerant changes state to a vapor. In the process of evaporating, the refrigerant absorbs latent heat from the surrounding environment. From the evaporator, the refrigerant flows to the compressor and the freeze cycle repeats itself. In a large ice making system, where a considerable amount of heat is released, the condenser is usually located far from the compressor, and typically outdoors.

In contrast to the freeze cycle, when an ice maker goes into "harvest," the refrigerant from the compressor is generally fed directly to the evaporator, rather than to the condenser. Because the heat from the vaporous refrigerant is used to melt and free the ice which has accumulated on the evaporator, ensuring an adequate transfer of heat from the compressor to the evaporator during the harvest cycle is a significant concern, particularly in those situations described below where an ice maker having a remote condenser is to operate over a range of ambient temperatures.

In many ice making systems which are designed to operate in low temperatures (e.g., below 50° F. ambient), a head pressure control valve is provided to maintain a minimum head pressure to assure that compressor heat will be available for the ice harvest cycle. Such a head pressure control valve is generally designed to back-up liquid refrigerant in the condenser during cold temperatures. This back-up procedure, however, results in extra refrigerant charge being added to the system. As long as the system has enough receiver capacity, this extra refrigerant does not hurt the system during the freeze cycle as the outdoor temperature rises. However, when the ice maker shifts to the harvest cycle, this extra refrigerant can overload the compressor and damage the system.

During the harvest cycle, the vaporous refrigerant is supplied to the evaporators through a hot gas valve that typically has a fixed orifice which acts as a metering device. In self-contained systems with relatively small refrigerant charges, this works satisfactorily and provides acceptable harvest times without returning unacceptable amounts of liquid refrigerant to the compressor. However, in systems having large refrigerant charges (typically where the condenser is remote from the compressor), the discharge pressure during the harvest cycle tends to be much higher at elevated ambient (outdoor) temperatures than the discharge pressure in self-contained systems. This higher pressure causes more refrigerant to flow through the fixed orifice in the hot gas valve and into the cold evaporator where it condenses. If this condensed refrigerant subsequently reaches the compressor, the compressor can become slugged with liquid refrigerant and its efficiency can be materially impaired. The liquid refrigerent can also dissolve the lubricant in the compressor, resulting in harmful friction between its moving parts. Reducing the orifice size of the hot gas valve, however, would cause unacceptably long harvest cycles when the discharge pressures are lower, such as occur at lower outdoor temperatures.

In a preferred ice making system, a predetermined amount of refrigerant would be circulated between the compressor and the evaporator during the harvest cycle. The amount of refrigerant to be circulated would vary from system to system depending upon operating conditions, such as the ambient temperatures. In such an arrangement, the amount of refrigerant needed to ensure an efficient harvest cycle could be monitored by the compressor's suction pressure, and additional refrigerant could be added if needed. In this way, the ice maker would have the proper amount of refrigerant available during both the freeze and harvest cycles.

SUMMARY OF THE INVENTION

A general object of the invention is to provide an ice making system with an effective, reliable and economically feasible means for controlling the amount of refrigerant in the system during the ice harvest cycle. A related object of the invention is to minimize harvest time and ice meltaway problems, thereby achieving an efficient operation and maximum unit ice production.

A more specific object of the invention is to provide an ice harvest pressure regulator valve for an ice making system.

Another specific object of the present invention is to reduce the chance that liquid refrigerant might enter the compressor cylinders and thus cause valve or head gasket failures. This object is realized by the control of the amount of refrigerant utilized during harvest, and by the provision that only a small quantity of saturated refrigerant can return to the compressor.

A further object of the invention is to provide an ice making system which is tolerant to refrigerant overcharge situations by ensuring that only the required amount of refrigerant is circulated between the compressor and the evaporator during the harvest cycle.

In accordance with the present invention, these objects are realized by a harvest pressure regulating assembly comprising a unique system for diverting the refrigerant supplied by the compressor to the evaporator during the harvest cycle and which can add refrigerant to the system as required for efficient operation. Other objects and advantages of the invention will become apparent upon studying the following description and accompanying drawing.

DESCRIPTION OF THE DRAWINGS OF THE INVENTION

In the accompanying drawing, FIG. 1 is a diagram of an ice making system designed in accordance with the present invention.

DESCRIPTION OF THE PREFERRED EMBODIMENT OF THE INVENTION

Figure 1:
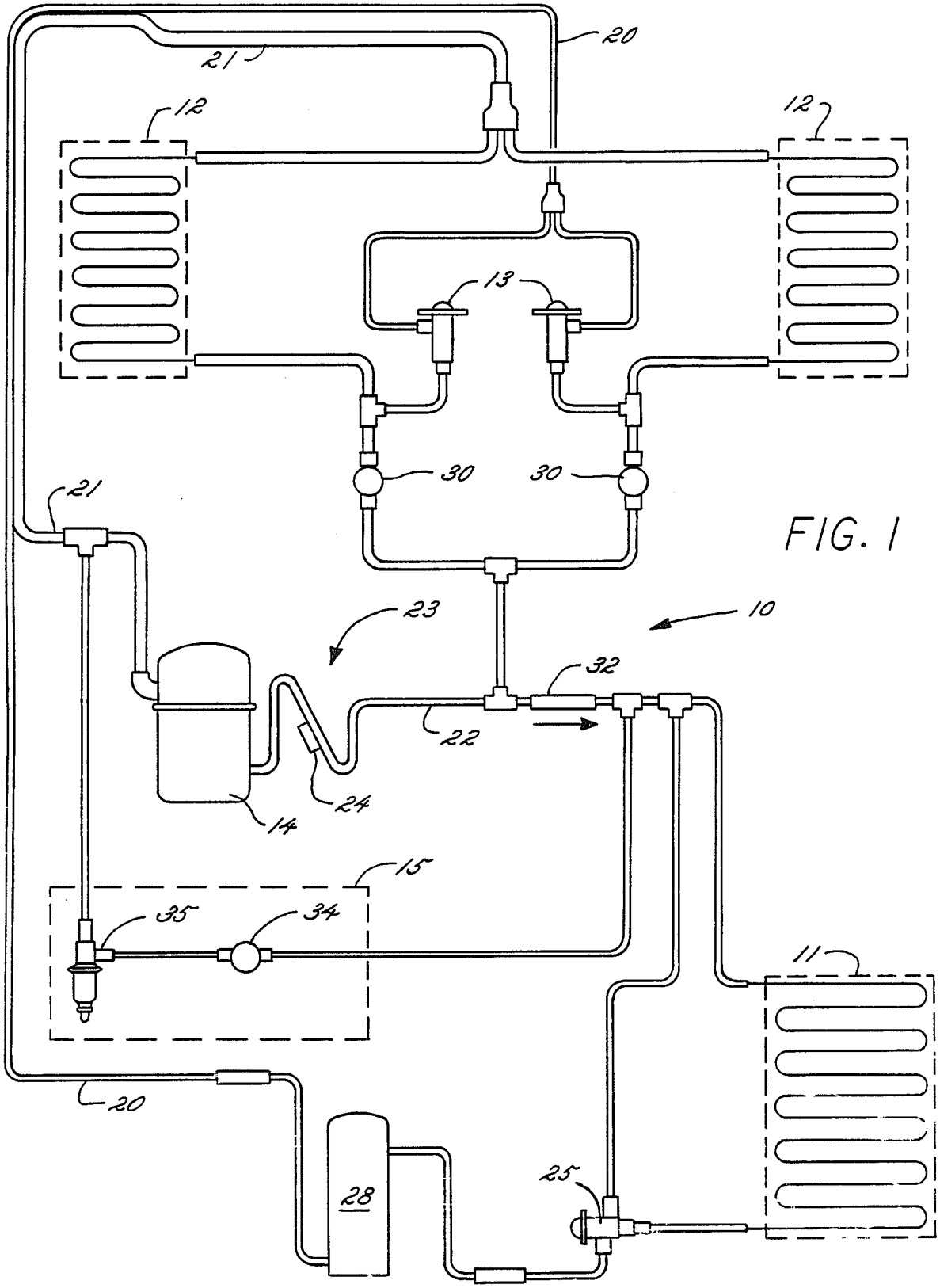

As shown in FIG. 1, an ice making system 10 designed in accordance with the present invention includes a condenser 11, evaporators 12, expansion valves 13, a compressor 14 and a harvest pressure regulator valve system 15. Although only one evaporator is necessary for the majority of ice making machines, the ice making system depicted in FIG. 1 has two evaporators, which can be placed at the front and rear, respectively, of the ice making unit.

When the ice maker is in the freeze mode, a liquid refrigerant is supplied along a feed line 20 from the condenser through the expansion valves 13, which serve to lower the pressure of the liquid refrigerant, to the evaporators 12. Within the evaporators 12, the liquid refrigerant evaporates, absorbing heat and thereby cooling the evaporators 12 and anything in thermal contact with them. The vaporized refrigerant is then drawn by the compressor's suction pressure along a supply line 21 into the compressor 14 where it is compressed, increasing both the temperature and pressure of the vaporous refrigerant. From the compressor, the high temperature, high pressure vaporous refrigerant is forced along a discharge line 22 to the condenser 11, where the vaporous refrigerant condenses, rejecting heat to the condenser environment. As shown in FIG. 1, a compressor protection assembly 23, such as that disclosed in U.S. patent application Ser. No. 552,608, which is assigned to The Manitowoc Company, Inc., may be disposed along the discharge line 22 near the compressor to maintain a high temperature, high pressure "bubble" of vaporous refrigerant in the discharge line to prevent liquid refrigerant from migrating back into the compressor 14. As disclosed in the drawing, the compressor protection assembly 23 comprises a vertically oriented, N-shaped trap and a temperature responsive heater unit 24.

For large refrigeration systems, which reject a considerable amount of heat, the condenser 11 is often located far from the compressor 14 and typically outdoors. Thus the feed line 20 and the discharge line 22 are frequently quite long. To control the head pressure in the system, a head pressure control valve 25 is provided in the feed line 20 between the condenser 11 and the expansion valves 13. The head pressure control valve 25 is also teed into the discharge line 22 and controls the head pressure by backing up liquid refrigrant into the condenser 11. During cold ambient temperatures, this can result in extra refrigerant being added to the system. A reservoir or "receiver" 28 may be placed between the head pressure cntrol valve 25 and the expansion valves 13 to receive this additional refrigerant.

In practice, so long as the ice making system has sufficient receiver capacity to contain the additional refrigerant needed during lower ambient temperatures, the extra refrigerant does not damage the system during the freeze cycle as the ambient temperature rises. Additional refrigerant, however, could cause damage to the compressor if it is drawn into the evaporators. This can occur during the harvest cycle. In prior ice making systems, when hot vaporous refrigerant is fed directly into the evaporators, the pressure in the condenser will drop, and the liquid refrigerant contained therein, now at a lower pressure, will boil. Unless the condenser is isolated during harvest, vaporous refrigerant could flow back and be drawn into the evaporators, where it will condense and migrate to the compressor.

When the ice making system shown in FIG. 1 goes into the harvest, two normally closed hot gas solenoid valves 30 open, and hot vaporous refrigerant is fed directly into the evaporators 12. In accordance with the present invention, and in order to prevent vaporous refrigerant from being drawn from the condenser 11 and the receiver 28 during the harvest cycle, a normally open check valve 32 is installed downstream from the point where the hot gas valves 30 are teed into the discharge line 22. The check valve 32 permits the flow of refrigerant from the compressor 14 to the condenser 11 and is closed to flow in the opposite direction during the harvest cycle to prevent the large refrigerant charge in the remote system from flowing to the evaporators 12. However, by preventing the refrigerant in the receiver and condenser from flowing back during harvest, the now isolated circuit between the compressor and evaporators may be low on refrigerant.

To correct this deficiency, a harvest pressure regulator valve system 15 is provided to add vaporous refrigerant to the isolated circuit. The harvest pressure regulator system 15 of the present invention includes a normally closed harvest pressure regulating solenoid 34 and a harvest pressure regulating valve 35. The normally closed solenoid 34 is open during the harvest cycle to allow vaporous refrigerant to flow to the regulating valve 35, which is teed into the supply line 21 between the evaporators 12 and the compressor 14.

The amount of refrigerant to be added during the harvest cycle is monitored by the compressor's suction pressure, and the regulating valve 35 is preset to permit a flow of refrigerant therethrough only so long as the pressure in supply line 21 is below a predetermined level. When the pressure in supply line 21 is equal to greater than the predetermined level, valve 35 will close and the flow of vaporous refrigerant therethrough will be restricted. In this way, additional vaporous refrigerant can be supplied automatically to the system during the ice harvest cycle so that a constant, predetermined amount of refrigerant circulates between the evaporators 12 and the compressor 14. As shown in FIG. 1, the vaporous refrigerant supplied to the harvest pressure regulating valve 35, and used to raise the harvest pressure in line 21, can come from the condenser or can be drawn from the top of the receiver 28, from above the level of the liquid refrigerant contained therein, through supply line 20.

While the harvest pressure regulator valve system has been described in the context of an ice making system, the invention can be used in a wide variety of refrigeration systems, and is consequently not limited to the embodiment described herein. It should be understood that alternative embodiments and modifications which would still be encompassed by the invention may be made by those skilled in the art, particularly in light of the foregoing teachings. The following claims are consequently intended to cover any alternative embodiments, modifications, or equivalents which may be included within the spirit and scope of the invention as claimed.

I claim as my invention:

1. In an ice making system having a compressor, a condenser and an evaporator, and having an ice harvest cycle wherein a vaporous refrigerant is circulated from the compressor through a discharge line to the evaporator and thereafter returned to the compressor through a supply line, means for maintaining a predetermined amount of refrigerant circulating between the compressor and the evaporator during the harvest cycle, said means comprising a normally closed valve disposed between the compressor and the evaporator, said normally closed valve being open during the harvest cycle to permit the flow of vaporous refrigerant therethrough, a check valve disposed between the condenser and the compressor, said check valve preventing the backflow of refrigerant from the condenser to the evaporator during the harvest cycle, and regulating valve means for automatically adding vaporous refrigerant to the supply line during the harvest cycle when the pressure in the supply line falls below a predetermined level, said regulating valve means being open to flow therethrough only during the harvest cycle when the pressure in the supply line falls below the predetermined level.

2. The ice making system as claimed in claim 1 wherein the regulating valve means includes a normally closed harvest valve, said normally closed harvest valve being open during the harvest cycle to permit the flow of vaporous refrigerant therethrough.

3. The ice making system as claimed in claim 2 wherein the normally closed harvest valve is a solenoid valve.

4. The ice making system as claimed in claim 1 wherein the regulating valve means includes a normally closed harvest valve and a harvest pressure regulating valve, the harvest pressure regulating valve being set to open when the pressure in the supply line falls below the predetermined level, and the normally closed harvest valve being open during the harvest cycle to permit the flow of vaporous refrigerant therethrough.

5. The ice making system as claimed in claim 4 wherein the condenser supplies the vaporous refrigerant to be added to the supply line when the pressure therein falls below the predetermined level.

6. The ice making system as claimed in claim 4 wherein a receiver for liquid refrigerant is disposed between the condenser and the evaporator, and the vaporous refrigerant which is added to the supply line when the pressure therein falls below the predetermined level is taken from the top of said receiver, from above the level of liquid contained therein.

7. The ice making system as claimed in claim 4 wherein a receiver for a refrigerant is disposed between the condenser and the evaporator, and the vaporous refrigerant which is added to the supply line when the pressure therein falls below the predetermined level is supplied from the condenser and from the top of said receiver, from above the liquid contained therein.

8. In an ice making system having a compressor, a condenser and an evaporator and a receiver for liquid refrigerant disposed therebetween, and having an ice harvest cycle wherein a vaporous refrigerant is circulated from the compressor through a discharge line to the evaporator, and thereafter returned from the evaporator to the compressor through a supply line, means for maintaining a predetermined amount of refrigerant circulating between the compressor and the evaporator during the harvest cycle, said means comprising a normally closed valve disposed between the compressor and the evaporator, said normally closed valve being open during the harvest cycle to permit the flow of vaporous refrigerant therethrough, a check valve disposed between the condenser and the compressor, said check valve preventing the back flow of refrigerant from the condenser and the receiver to the evaporator during the harvest cycle, and regulating means for automatically adding vaporous refrigerant from the condenser and from the top of the receiver to the supply line when the pressure therein falls below a predetermined level, said regulating valve means comprising a harvest pressure regulating valve which is set to open when the pressure in the supply line falls below a predetermined level, and a normally closed harvest valve, said normally closed harvest valve being open during the harvest cycle to permit the flow of vaporous refrigerant from the condenser and the receiver to the harvest pressure regulating valve.

9. In an ice making system having a compressor, a condenser and an evaporator, and having an ice harvest cycle wherein a vaporous refrigerant is circulated from the compressor through a discharge line to the evaporator and thereafter returned to the compressor through a supply line, means for maintaining a predetermined amount of refrigerant circulating between the compressor and the evaporator during the harvest cycle, said means comprising a normally closed valve disposed between the compressor and the evaporator, said normally valve being open during the harvest cycle to permit the flow of vaporous refrigerant therethrough, a check valve disposed between the condenser and the compressor, said check valve preventing the backflow of refrigerant from the compressor to the evaporator during the harvest cycle, and valve means for automatically adding vaporous refrigerant to the supply line only during the harvest cycle.

* * * * *